United States Patent [19]

Tengs

[11] Patent Number: 4,627,110

[45] Date of Patent: Dec. 9, 1986

[54] ARTICLE OF WEARING APPAREL WITH AN ERASABLE WRITING SURFACE

[76] Inventor: Anthony M. Tengs, P.O. Box 45008, Seattle, Wash. 98145

[21] Appl. No.: 542,270

[22] Filed: Oct. 17, 1983

[51] Int. Cl.[4] ..... A41D 1/00; A41D 27/08

[52] U.S. Cl. ..... 2/69; 2/115; 2/244

[58] Field of Search ..... 2/244, 1, 115, 69

[56] References Cited

U.S. PATENT DOCUMENTS 3,642,562 2/1972 Kawaguchi ..... 35/66 X
3,777,418 12/1973 Cooper ..... 35/62
3,922,457 11/1975 Barnwell et al. ..... 428/207

FOREIGN PATENT DOCUMENTS 781033 2/1935 France .
1422886 11/1965 France .
1450281 9/1976 United Kingdom .

*Primary Examiner*—H. Hampton Hunter
*Attorney, Agent, or Firm*—Christensen, O'Connor, Johnson & Kindness

[57] ABSTRACT

An article of wearing apparel, such as a shirt, has a writing surface provided on a prominent portion thereof when worn by a user. A written message or other image may be applied to the writing surface by a suitable writing medium. The materials for the writing surface and the writing medium are selected such that written matter may easily be applied to, and removed from the writing surface.

16 Claims, 4 Drawing Figures

Fig. 3.
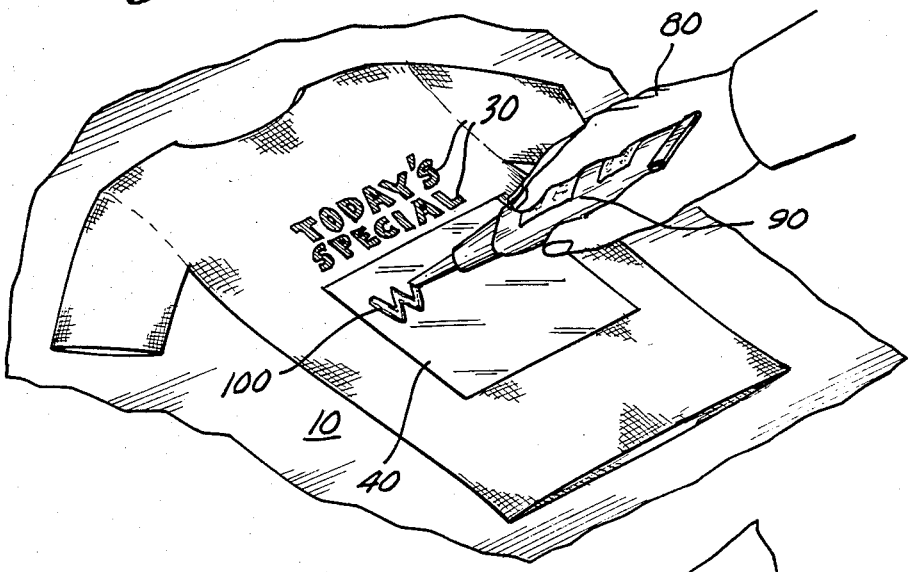
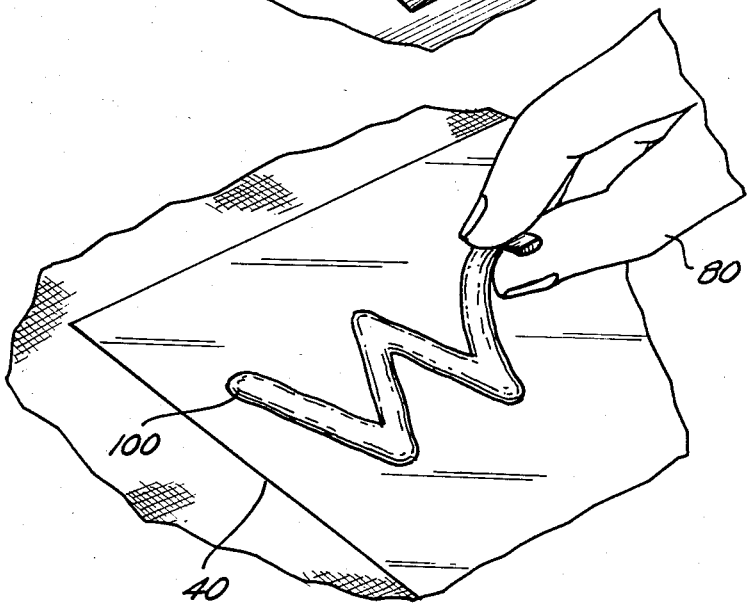
Fig. 4.

ARTICLE OF WEARING APPAREL WITH AN ERASABLE WRITING SURFACE

BACKGROUND OF THE INVENTION

The present invention pertains to the garment art and, more particularly, to an article of wearing apparel having a writing surface provided thereon, and writing means for applying an erasable or otherwise removable image to said writing surface.

There are many situations in which lettering or numbering on a garment serve an identification purpose. One common example is in spotswear wherein the name of a team, as well as a player number, may be affixed to a player's shirt or jersey. The lettering for such garments is usually permanent, as may be produced by a silkscreen process or by sewing or cementing cloth letters onto the garment. There are many situations, however, wherein it is desirable to change the designation of a given player, or his representative team. To this end, it is known to provide garments, such as shirts, having fasteners which are adapted to receive different panels, whereby a player's designation may be changed by replacing the panel on his shirt. The fabrication of a garment with fasteners, along with corresponding panels, is, however, relatively expensive and the resultant assembly is clumsy in use.

There are many other instances in which it would be desirable to provide an article of wearing apparel which is capable of bearing erasable messages. For example, a message may be provided on the clothing of a road construction worker, warning passing motorists of road hazards or conditions. Examples of such warning messages include "SLOW", "STOP AHEAD", or "BLASTING AREA".

Garment writing surfaces might bear messages providing information to the public. For example, in restaurants, the writing surface worn by restaurant employees could list special menu items.

A garment with a writing surface might also bear advertisement information. That is, a user desiring to promote a certain product could place an ad for the product directly on his garment, the message then being brought to the attention of the public by the mere wearing of the article by the user.

SUMMARY OF THE INVENTION

It is an object of this invention, therefore, to provide an article of wearing apparel having a writing surface provided on a prominent portion thereof when worn by a user, and a writing medium which, along with the writing surface, allows a user to both write on, and remove writing from the writing surface.

Briefly, according to the invention, a garment comprises an article of wearing apparel having a writing surface provided on a prominent portion thereof when worn by a user. A writing medium provides a means for writing on the writing surface. The writing surface and the writing medium are comprised of materials which allow a user to both write on and remove writing from the writing surface.

In preferred constructions of the invention, various writing surfaces are employed such as nylon, polyurethane treated nylon, vinyl, microporous-semipermeable materials and leather. Various writing media for use with the writing surfaces are disclosed and include ink marking pens, chalk, enamel, grease pens, adhesive caulking compounds and liquid latex.

BRIEF DESCRIPTION OF THE DRAWINGS

FIG. 3 is a perspective view of a T-shirt having a writing surface, and illustrates a user writing on the writing surface with an adhesive caulking compound; and FIG. 4 is a partial view of the writing surface shown on the shirt of FIG. 3, wherein a user is shown removing the displayed writing by means of peeling off the adhesive caulking compound.

DETAILED DESCRIPTION

Figure 1:
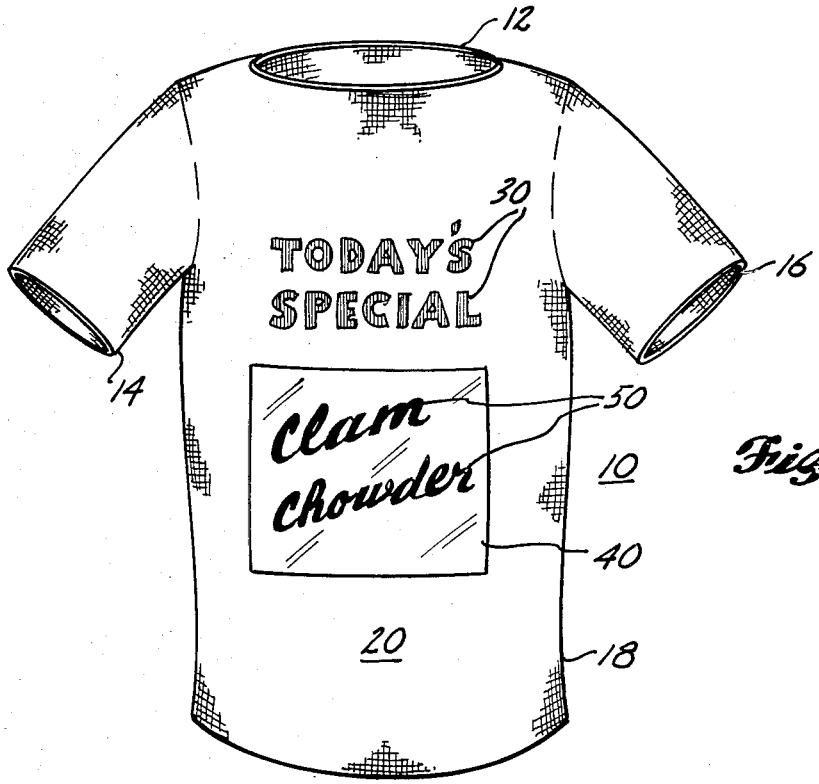
FIG. 1 is a perspective view of a T-shirt provided with fixed lettering as well as a writing surface with erasable writing shown thereon.

FIG. 1 illustrates a T-shirt, indicated generally at 10, having a neck opening 12, sleeve sections 14, 16 and a trunk portion 18. The front surface of the T-shirt 10 is indicated generally at 20.

Provided on the upper portion of the T-shirt front surface 20 is permanent lettering 30, here displaying the message "TODAYS SPECIAL". The fixed lettering 30 may be provided by conventional means such as silkscreening or cutout fabric letters which are sewn or cemented to front surface 20.

Positioned directly beneath the fixed lettering 30 is a writing surface 40. The writing surface, formed of an appropriate material as described below, allows a user to write his own message on the T-shirt 10. While in this, the preferred embodiment of the invention the writing surface 40 is shown on the front surface 20 of a T-shirt, it should be understood that the invention is equally applicable to any other prominent surface of the T-shirt 10 or any other article of wearing apparel, wherein the writing surface is provided on a prominent portion thereof when worn by a user.

In one particular construction of the invention, the writing surface 40 was comprised of a sheet of any of the materials described below, formed as a 9-inch wide by 7-inch high rectangle. This sheet may be affixed to the front surface 20 of T-shirt 10 by conventional means, such as sewing or a fabric cement or glue.

Shown written on the writing surface 40 is the message "CLAM CHOWDER" indicated generally at 50, which completes the message initiated by the permanent lettering 30. As will be understood more fully with respect to the discussion hereinbelow, the writing medium for the message 50, as well as the material which forms the writing surface 40, allows a user to easily write on, and remove the message 50 from the writing surface 40.

Figure 2:
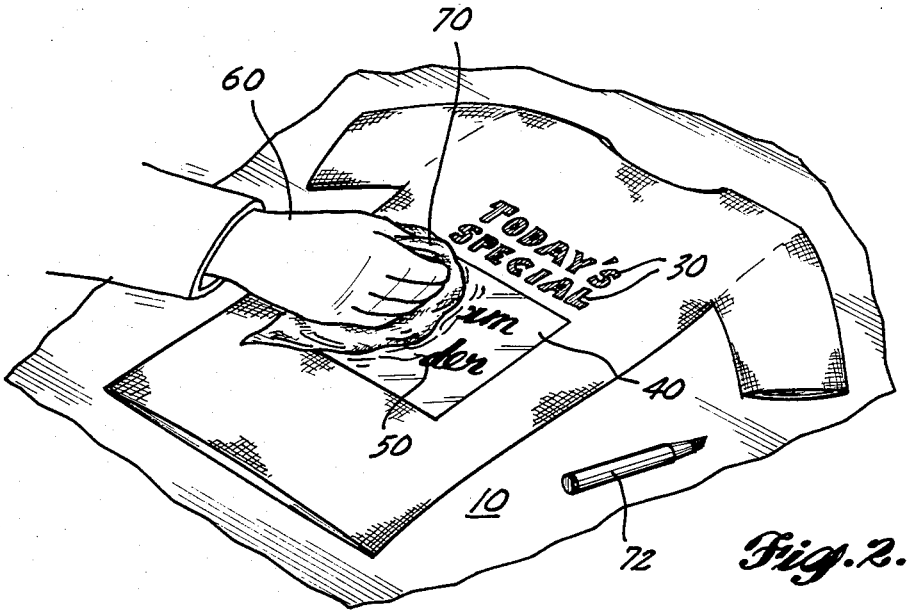
FIG. 2 is a perspective view of the T-shirt of FIG. 1, wherein the message on the writing surface is shown being erased.

FIG. 2 illustrates the T-shirt 10 being placed on a level surface, with the front surface 20 face-up. A hand 60 of a user is shown with a damp cloth 70, in the action of erasing the message 50 from the writing surface 40. There are many applications in which the material selected for the writing surface 40, along with the medium selected for use in forming the message 50 may be easily erased by a user simply by the expedient of wiping off the lettering with a cloth, such as cloth 70. Once the old message 50 has been erased, a new message may be written on the writing surface 40 as, for example, by use of the ink marking pen 72.

FIG. 3 is a perspective view of a T-shirt 10, wherein the T-shirt is placed on a level surface for purposes of applying a message. As with the shirt of FIG. 1, T-shirt 10 includes permanent lettering 30 and, positioned directly therebeneath, a writing surface 40. A user's hand 80 is shown grasping a tube 90 of an adhesive caulking compound, and squeezing the caulking therein out onto the writing surface 40, thereby forming the letter "W" at 100.

FIG. 4 is a partial view of the writing surface 40 shown in FIG. 3, wherein the letter "W," which has been given an opportunity to set, is shown being removed from the writing surface 40 by the expedient of the user's hand 80 simply peeling the letter off of the writing surface 40. Once this is accomplished, the user may then write a new message on the writing surface 40.

Numerous materials have been found which are suitable for use as the erasable writing surface 40 as described herein.

For example, the writing surface may be comprised of nylon, in which case an adhesive caulk may be used as the writing medium. As used herein, the terms "caulk", "adhesive caulking compound" or "caulking compound" refer to any one of several available caulking compounds generally sold as elastomeric sealants, and which, for example, may be comprised of 100% silicone rubber, acrylic latex or acrylic caulk. It has been found that at room temperature the setting time for a caulk to dry from its flowable phase to a semihard phase, thereby producing a stable image on a garment, is approximately 15–30 minutes. This drying time may be shortened upon application of heat such as a stream of warm air.

Where the writing surface is formed of nylon, another material that has been found to work as a writing medium is liquid latex. Liquid latex is commonly sold as a cosmetic, particularly for use in theatrical productions. The liquid latex may be dispensed by brush, squeeze bottle having a controlled nozzle, or other suitable dispensing means.

An alternative material for the writing surface may be "treated" or polyurethane treated nylon. Here, ink marking pens which use a water soluble ink may be used as the writing medium. Alternatively, chalk, liquid enamel paint or an adhesive caulk may be used as the writing medium on treated nylon.

Vinyl is an alternative material for the writing surface. Here, either a grease pen, chalk, or an erasable ink may be used as the writing medium.

Further, a microporous, semipermeable material, as sold, for example, under the trade name Gortex, may serve as the writing surface. Here, conventional marking pencils, marking pens with water soluble ink, caulking compounds, or liquid latex may be used as the writing medium.

Also, leather may serve as the writing surface, in which case caulking compounds or liquid latex provide excellent writing media.

It will be noted that where the writing medium comprises caulking compounds, liquid latex or enamel, the writing may be removed as illustrated in FIG. 4 by peeling off each character. For all other disclosed writing media, the damp cloth type erasing, as shown in FIG. 2, may be employed, with a common eraser being suitable for erasing pencil and erasable inks.

Further, where the writing medium is comprised of a caulking compound, it has been found that colored marking pens may be used on the caulk to alter the color thereof.

In summary, a garment having an article of wearing apparel with an erasable writing surface has been described. Suitable writing medium, along with the proper selection of the material used in the writing surface allows a user to easily write on, and remove writing from the writing surface.

While a preferred embodiment of the invention has been described in detail, it should be apparent that many modifications and variations thereto are possible, all of which fall within the true spirit and scope of the invention.

The embodiments of the invention in which an exclusive property or privilege is claimed are defined as follows:

1. A garment comprising:

an article of wearing apparel for covering the torso of a human body, said article of wearing apparel having a writing surface provided on a torso covering exterior portion thereof that is readily observable by others when the article of wearing apparel is worn by a user, said writing surface forming a permanent portion of said article of wearing apparel, said article of wearing apparel also having permanent writing provided on said torso covering exterior portion thereof adjacent to said writing surface, said permanent writing being predeterminedly positioned with respect to said writing surface; and writing means for writing on said writing surface, said writing surface and said writing means being comprised of materials which allow a user to write on, and remove writing from said writing surface.

2. The garment of claim 1, wherein said article of wearing apparel is a shirt.

3. The garment of claim 2, wherein said writing surface is provided on the front surface portion of said shirt.

4. The garment of claim 1, wherein said writing surface is formed of nylon.

5. The garment of claim 4, wherein said writing means is comprised of an elastomeric sealant.

6. The garment of claim 4, wherein said writing means is comprised of liquid latex.

7. The garment of claim 1, wherein said writing surface is comprised of a polyurethane treated nylon surface.

8. The garment of claim 5, wherein said writing means is comprised of an elastomeric sealant.

9. The garment of claim 1, wherein said writing surface is formed of vinyl.

10. The garment of claim 1, wherein said writing surface is formed of a microporous, semipermeable material.

11. The garment of claim 10, wherein said writing means is comprised of an elastomeric sealant.

12. The garment of claim 10, wherein said writing means is comprised of a liquid latex.

13. Apparatus for creating a message bearing garment suitable for covering the torso of a human body, said apparatus comprising:

an article of wearing apparel for covering the torso of a human body, said article of wearing apparel having a writing surface on the exterior of the torso covering portion thereof that is readily observable by others when the article of wearing apparel is worn by a user, said writing surface forming a permanent portion of said article of wearing apparel, said writing surface being formed of a material to which an elastomeric sealant will adhere to and be peelable away from without damage to said writing surface; and, elastomeric sealant writing means for creating a stable viewable image on said writing surface, said elastomeric sealant being formed of an adhesive caulking compound that sets from a flowable application phase to a dry semihard phase at room temperature, said adhesive caulking compound being adhesively attachable to said writing surface when in said flowable application phase and manually peelable away from said writing surface when in said dry semihard phase.

14. The garment of claim 13, wherein said writing surface is formed of a microporous, semipermeable material.

15. The garment of claim 16, wherein said writing surface is formed of nylon.

16. The garment of claim 14, wherein said writing surface is formed of a polyurethane treated nylon surface.

* * * * *

UNITED STATES PATENT AND TRADEMARK OFFICE

CERTIFICATE OF CORRECTION

PATENT NO. : 4,627,110

DATED : December 9, 1986

INVENTOR(S) : Anthony M. Tengs

It is certified that error appears in the above-identified patent and that said Letters Patent is hereby corrected as shown below:

| | | |
|---|---|---|
| Column 4, | line 49: | "5" should be —7— |
| Column 6, | line 7: | "16" should be —14— |

Signed and Sealed this

Thirty-first Day of March, 1987

*Attest:*

DONALD J. QUIGG

*Attesting Officer*

*Commissioner of Patents and Trademarks*